US009937609B2

(12) United States Patent
Lee

(10) Patent No.: US 9,937,609 B2
(45) Date of Patent: Apr. 10, 2018

(54) NAIL-DRIVING GUN BARREL ASSEMBLY WITH A SAFE AND ROBUST CARTRIDGE EJECTION MECHANISM

(71) Applicant: Chung-Heng Lee, New Taipei (TW)

(72) Inventor: Chung-Heng Lee, New Taipei (TW)

( * ) Notice: Subject to any disclaimer, the term of this patent is extended or adjusted under 35 U.S.C. 154(b) by 436 days.

(21) Appl. No.: 14/620,741

(22) Filed: Feb. 12, 2015

(65) Prior Publication Data

US 2016/0236337 A1 Aug. 18, 2016

(51) Int. Cl.
*B25C 1/10* (2006.01)
*B25C 1/18* (2006.01)

(52) U.S. Cl.
CPC ..... *B25C 1/105* (2013.01); *B25C 1/18* (2013.01)

(58) Field of Classification Search
CPC .. B25C 1/00; B25C 1/10; B25C 1/105; B25C 1/14; B25C 1/143; B25C 1/18
USPC ..... 227/8, 9, 10, 156, 11; 411/439, 440
See application file for complete search history.

(56) References Cited

U.S. PATENT DOCUMENTS 2,912,779 A * 11/1959 Catlin ..... F41A 15/12 42/25
2,970,314 A * 2/1961 Temple ..... B25C 1/14 227/8
3,622,060 A * 11/1971 Gussalli ..... B25C 1/143 227/10
3,643,850 A * 2/1972 Endo ..... B25C 1/143 227/10
4,282,714 A * 8/1981 Fiocchi ..... B25C 1/105 227/9
4,890,778 A * 1/1990 Hawkins ..... B25C 1/105 227/10

* cited by examiner

*Primary Examiner* — Gloria R Weeks
*Assistant Examiner* — William A Weller
(74) *Attorney, Agent, or Firm* — Hamre, Schumann, Mueller & Larson, P.C.

(57) ABSTRACT

A nail-driving gun barrel assembly includes an axially extending barrel and an ejector. The barrel has a firing end portion having a cylindrical segment and a protruding segment that cooperates with the cylindrical segment to define a first cutout recess. The protruding segment is formed with a first groove. The ejector has a sleeve part and a projecting part which cooperates with the sleeve part to define a second cutout recess. The sleeve part is coaxially and slidably sleeved on the cylindrical segment. The projecting part is formed with a second groove. When the ejector is disposed at a first axial position, the first and second grooves mate each other.

6 Claims, 15 Drawing Sheets

NAIL-DRIVING GUN BARREL ASSEMBLY WITH A SAFE AND ROBUST CARTRIDGE EJECTION MECHANISM

BACKGROUND OF THE INVENTION

1. Field of the Invention

This invention relates to a nail-driving gun barrel assembly with a safe and robust cartridge ejection mechanism, more particular to a nail-driving gun barrel assembly including a barrel and an ejector having a cylindrical block sleeved coaxially and slidably on a firing end portion of the barrel for ejecting an exhaust explosive cartridge.

2. Description of the Related Art

Referring to FIGS. 1 to 2, U.S. Pat. No. 3,643,850 discloses a pin-driving tool that includes a barrel 12 having a rear part 121, an action housing 13 fitted slidably to the rear part 121 and carrying a breech block 14, and an L-shaped ejector 15 mounted to the rear part 121 and slidable relative to the rear part 121 between first and second axial positions (see FIGS. 1 and 2). The rear part 121 has a cutout surface 120, and is formed with a powder chamber 122 for receiving an explosive cartridge 10, a bottom slot 123, and a cutout recess 124. The L-shaped ejector 15 has an insertion section 151 which is inserted fittingly and movably in the bottom slot 123, and an ejecting section 152. The ejecting section 152 is received in the cutout recess 124, and mates the cutout surface 120 to define a stepped bore 1220 for accommodating the explosive cartridge 10 when the L-shaped ejector 15 is disposed at the first axial position. A pawl screw element 16 is secured to the active housing 13. The insertion section 152 is provided with a projection 17 that protrudes therefrom. After firing the explosive cartridge 10, the barrel 12 is moved frontwardly relative to the action housing 13 and the pawl screw element 16, so that the projection 17 is brought into contact with the pawl screw element 16 to move the L-shaped ejector 15 from the first axial position to the second axial position for ejecting the exhausted explosive cartridge 10.

An upper clearance (not shown) is formed between a downward-facing portion of the cutout surface 120 and a top end of the ejecting section 152 when the L-shaped ejector 15 is disposed at the first axial position. For safety, low noise and pin-driving efficiency reasons and for preventing explosive residue from entering the clearance and the action housing 13, the upper clearance should be as narrow as possible so as to reduce risks to safety, noise, and amounts of an explosion gas and the explosive residue escaping from the stepped bore 1220 and the powder chamber 122 through the clearance into the action housing 13. However, the configuration and arrangement of the L-shaped ejector 15 have a tendency to result in difficulty in controlling tolerances of the L-shaped ejector 15 in connection with tolerances of the rear part 121 of the barrel 12 during manufacturing or machining of the barrel 12 and the L-shaped ejector 15, which, in turn, may result in a relatively large clearance between the downward-facing portion of the cutout surface 120 and the top end of the ejecting section 152 of the L-shaped ejector 15.

Moreover, the explosion of the explosive cartridge 10 may result in fast recoil movement of the L-shape ejector 15, which can result in a strong impact between the projection 17 and the rear part 121, which, in turn, results in deformation of the projection 17.

SUMMARY OF THE INVENTION

Therefore, an object of the present invention is to provide a nail-driving gun barrel assembly that can overcome at least one of the aforesaid drawbacks associated with the prior art.

According to the present invention, there is provided a nail-driving gun barrel assembly with a safe and robust cartridge ejection mechanism. The nail-driving gun assembly comprises an axially extending barrel and an ejector. The barrel extends along an axial direction, and has a firing end portion that is adapted to accommodate an explosive cartridge. The firing end portion has a first cutout recess, a cylindrical segment, and a protruding segment that protrudes from the cylindrical segment along said axial direction and that cooperates with the cylindrical segment to define the first cutout recess. The protruding segment is formed with a first groove that extends in the axial, direction. The ejector is in the form of a generally cylindrical block that has a second cutout recess, a sleeve part, and a projecting part which protrudes from the sleeve part in the axial direction and which cooperates with the sleeve part to define the second cutout recess. The sleeve part is coaxially and slidably sleeved on and in sliding contact with the cylindrical segment so as to permit the ejector to be slidable on the cylindrical segment between first and second axial positions for ejecting the explosive cartridge out of the firing end portion of the barrel. The projecting part is formed with a second groove that extends in the axial direction. When the ejector is disposed at the first axial position, the protruding segment is disposed in the second cutout recess, the projecting part extends into the first cutout recess, and the first and second grooves mate each other to define a cylindrical bore that is adapted to accommodate the explosive cartridge. When the ejector is disposed at the second axial position, the projecting part protrudes outwardly of the first cutout recess and the first and second grooves do not mate each other to define the cylindrical bore.

BRIEF DESCRIPTION OF THE DRAWINGS

Other features and advantages of the present invention will become apparent in the following detailed description of the embodiment with reference to the accompanying drawings, of which.

DETAILED DESCRIPTION OF THE EMBODIMENT

Figure 1:
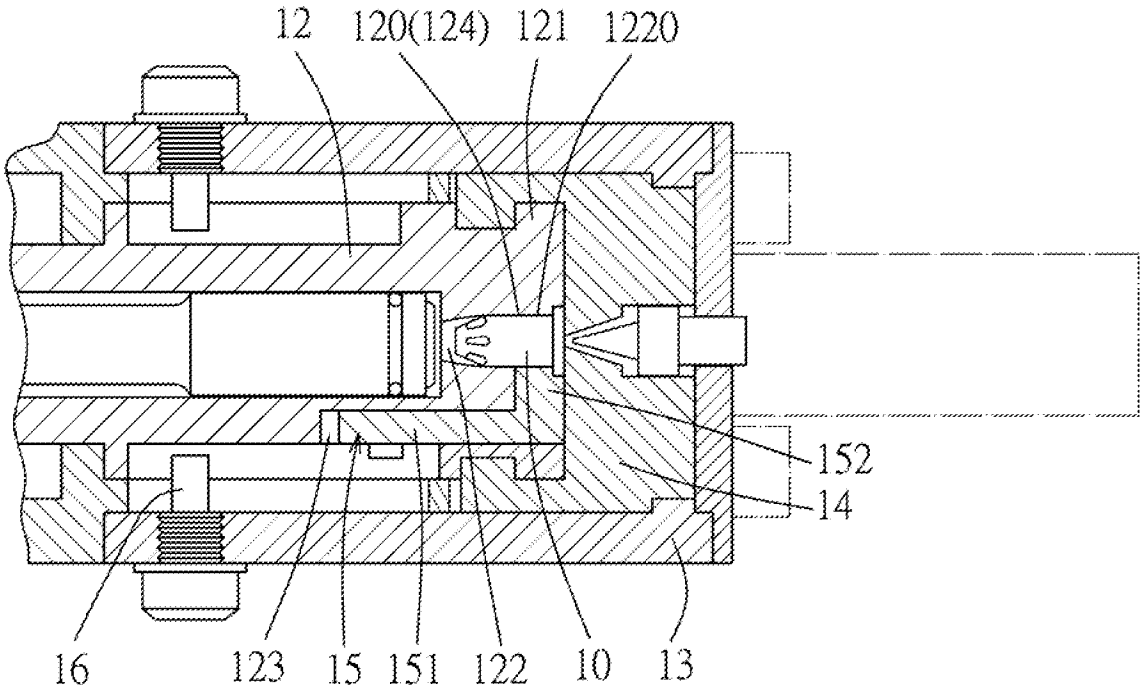
FIG.1 PRIOR ART
FIG. 1 is a fragmentary sectional view to illustrate a first state in which an L-shaped ejector of a conventional pin-driving tool is disposed at a first axial position.
Figure 2:
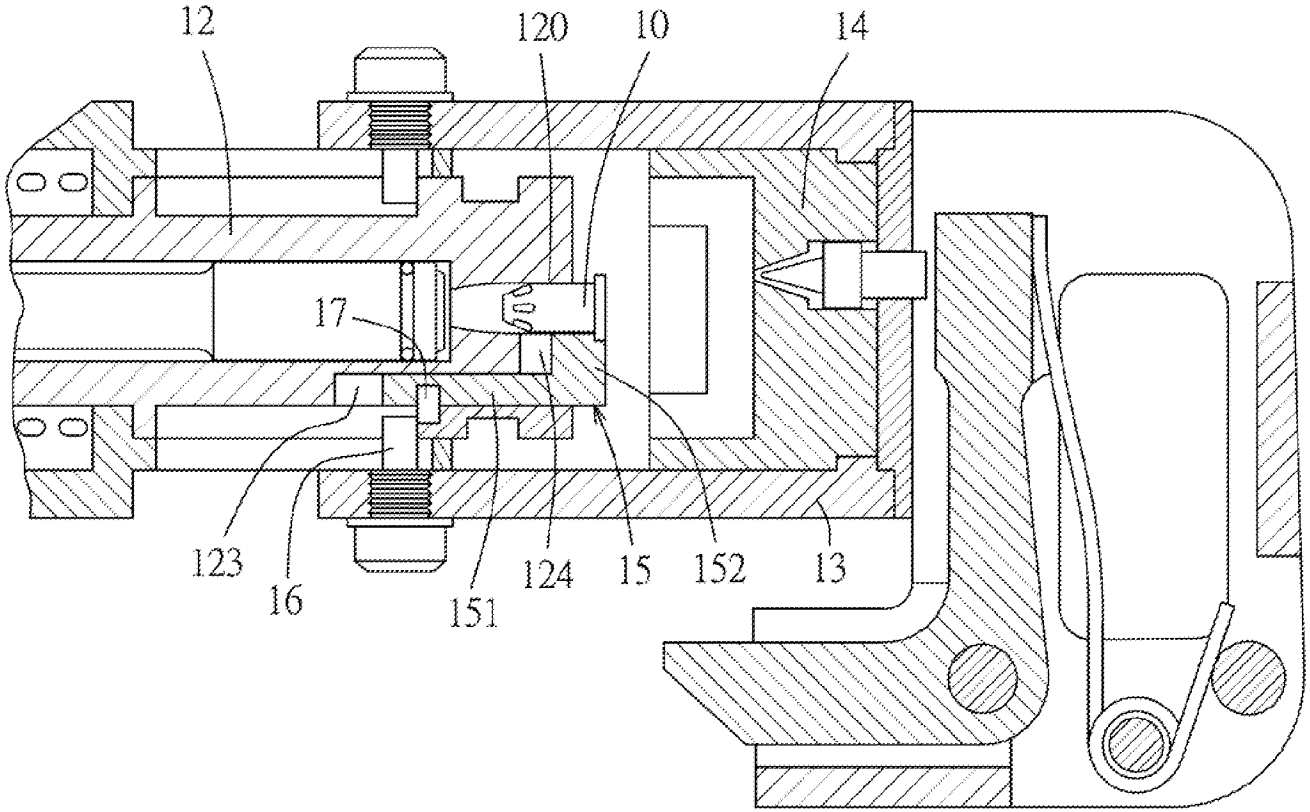
FIG.2 PRIOR ART
FIG. 2 is a fragmentary sectional view to illustrate a second state in which the L-shaped ejector of the conventional pin-driving tool is disposed at a second axial position.
Figure 3:
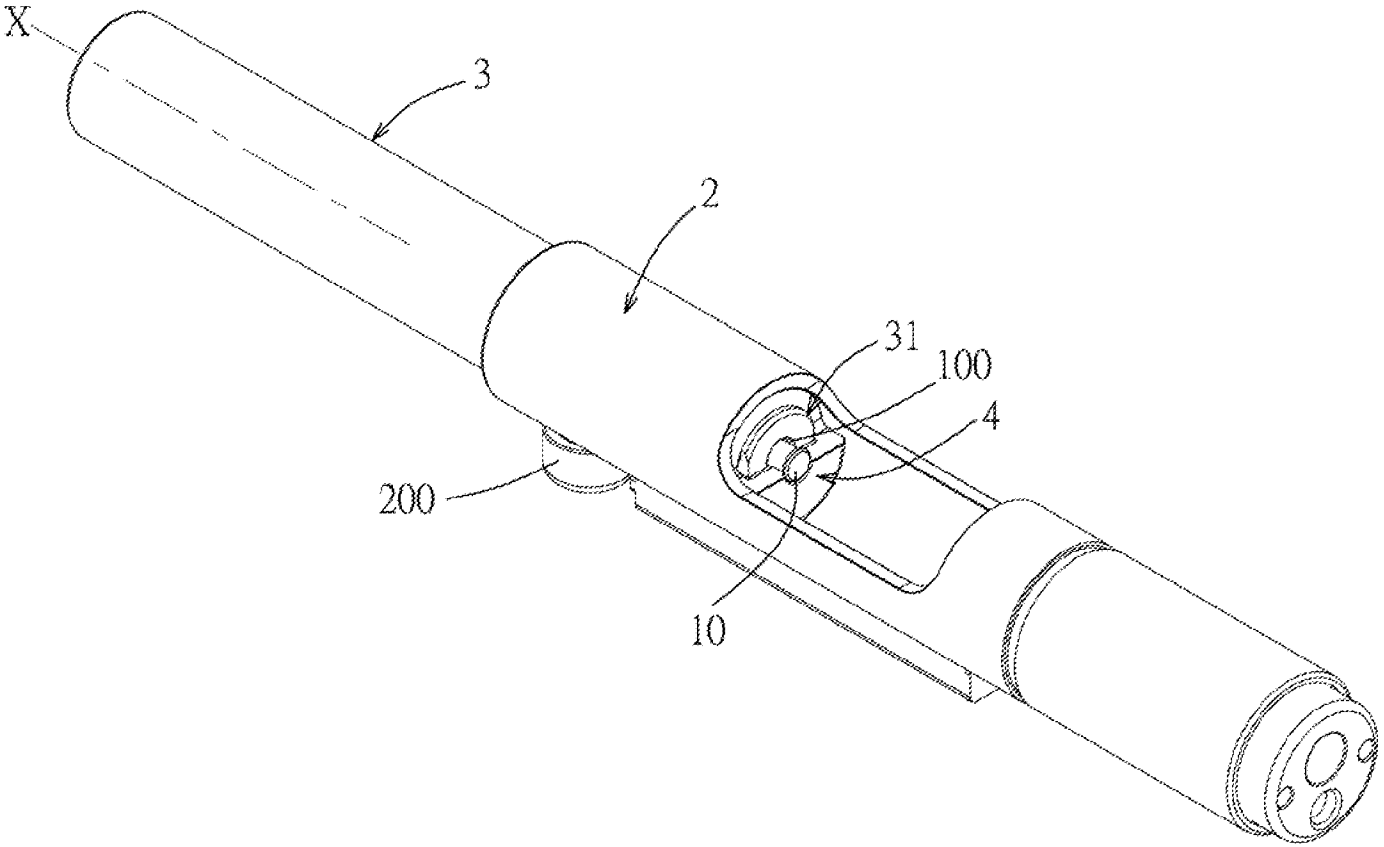
FIG. 3 is a perspective view of the embodiment of a nail-driving gun barrel assembly according to the present invention.
Figure 4:
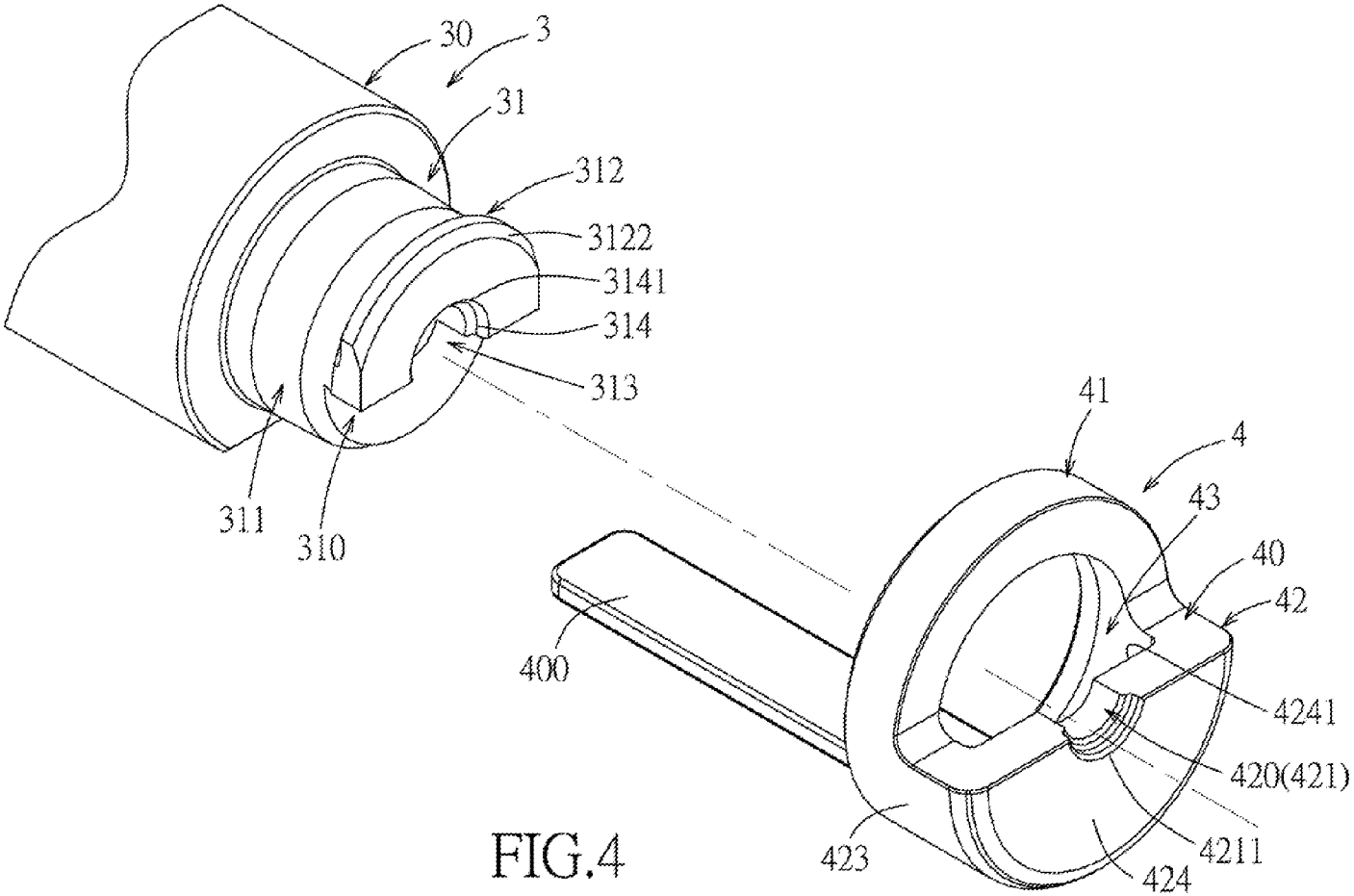
FIG. 4 is a fragmentary exploded perspective view of a barrel and an ejector of the embodiment.
Figure 5:
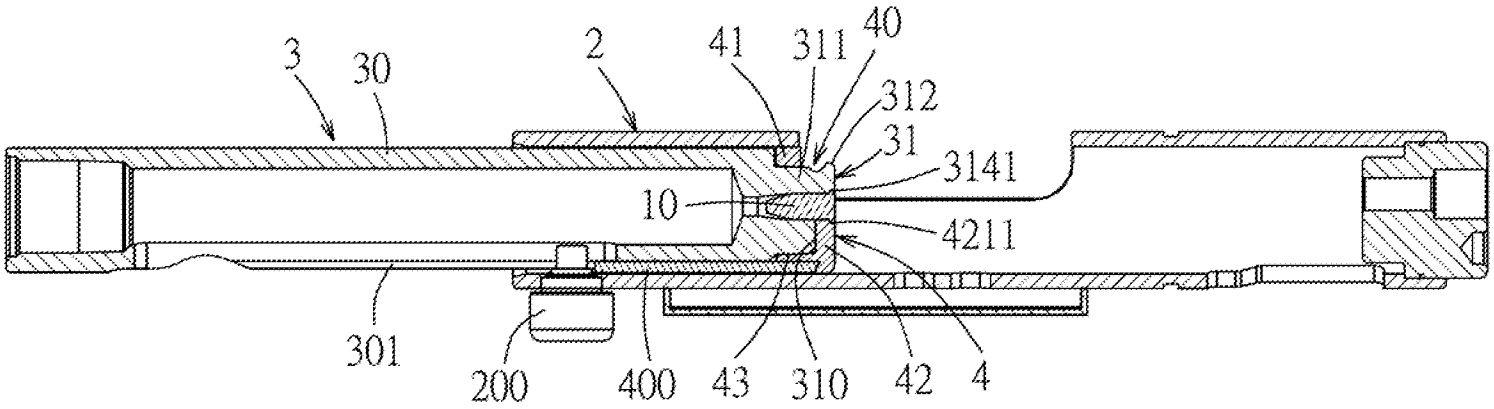
FIG. 5 is a sectional view illustrating a first state in which the ejector of the embodiment is disposed at a first axial position relative to the barrel.
Figure 6:
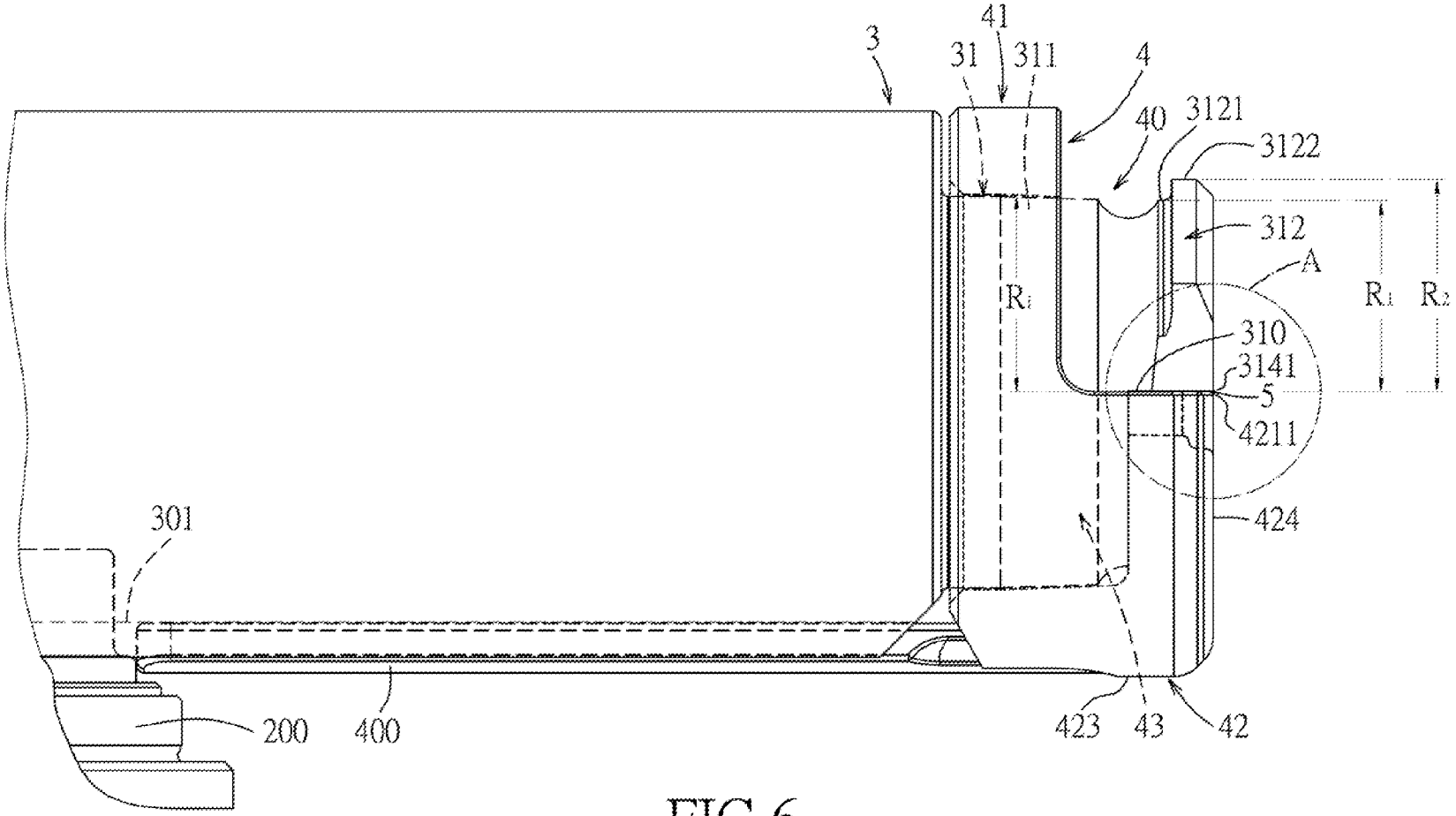
FIG. 6 is a fragmentary schematic view illustrating the first state of the embodiment.
Figure 7:
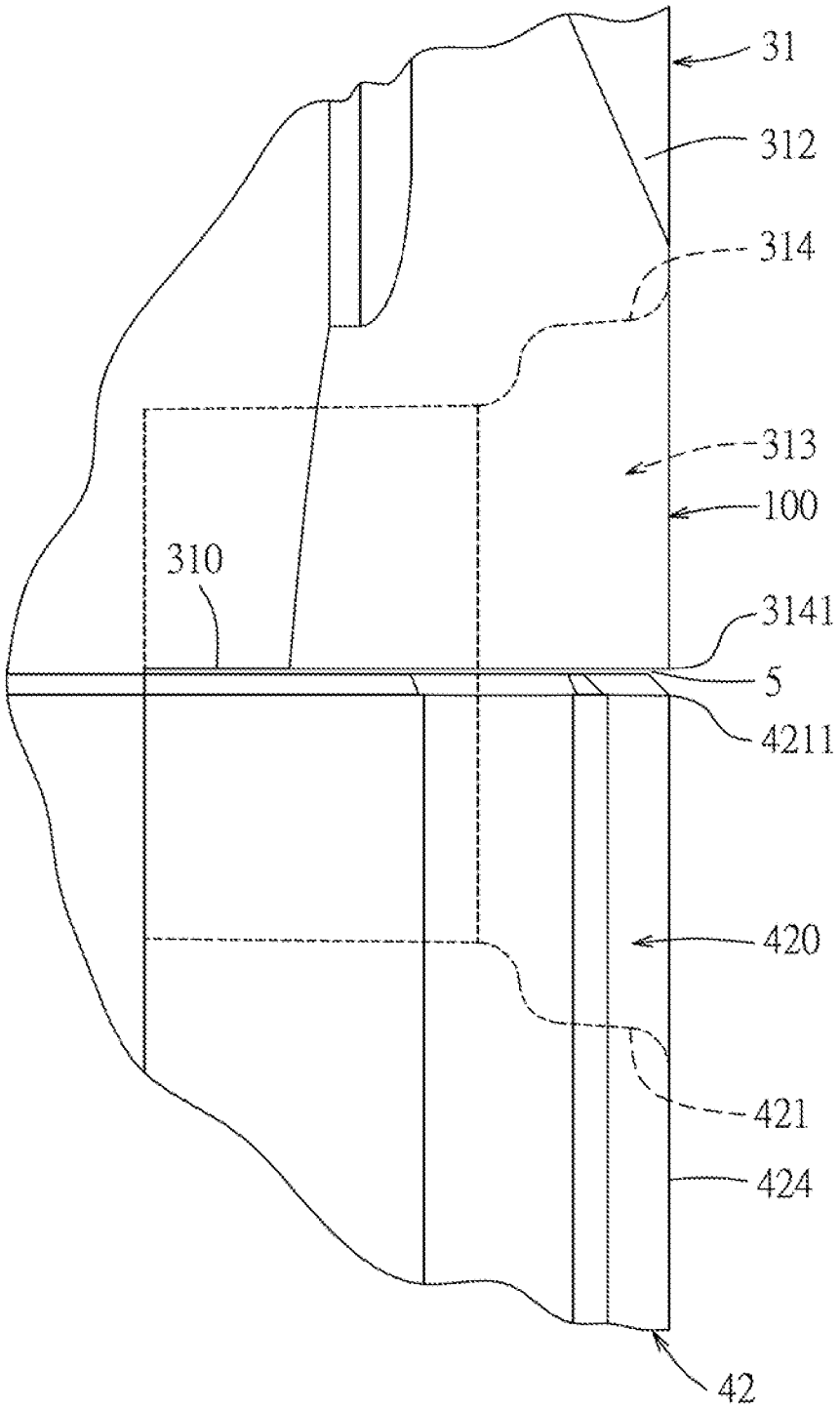
FIG. 7 is an enlarged view of the encircled portion A of FIG. 6.

FIGS. 3 to 7 illustrate the embodiment of a nail-driving gun barrel assembly with a safe and robust cartridge ejection mechanism according to the present invention. The nail-driving gun barrel assembly includes a housing 2, an axially extending barrel 3 extending into the housing 2, a piston (not shown) received movably in the barrel 3, and an ejector 4.

The barrel 3 defines a central axis (X), extends along the central axis (X), and has a firing end portion 31 that is adapted to accommodate an explosive cartridge 10. The firing end portion 31 has a first cutout recess 310, a cylindrical segment 311, and a protruding segment 312 that protrudes from the cylindrical segment 311 along an axial direction parallel to the central axis (X) and that cooperates with the cylindrical segment 311 to define the first cutout recess 310. The protruding segment 312 is formed with a first groove 313 that is in spatial communication with the cutout recess 310, that extends in the axial direction and that is defined by a first groove-defining surface 314. The first groove-defining surface 314 has an outer edge 3141.

Figure 8:
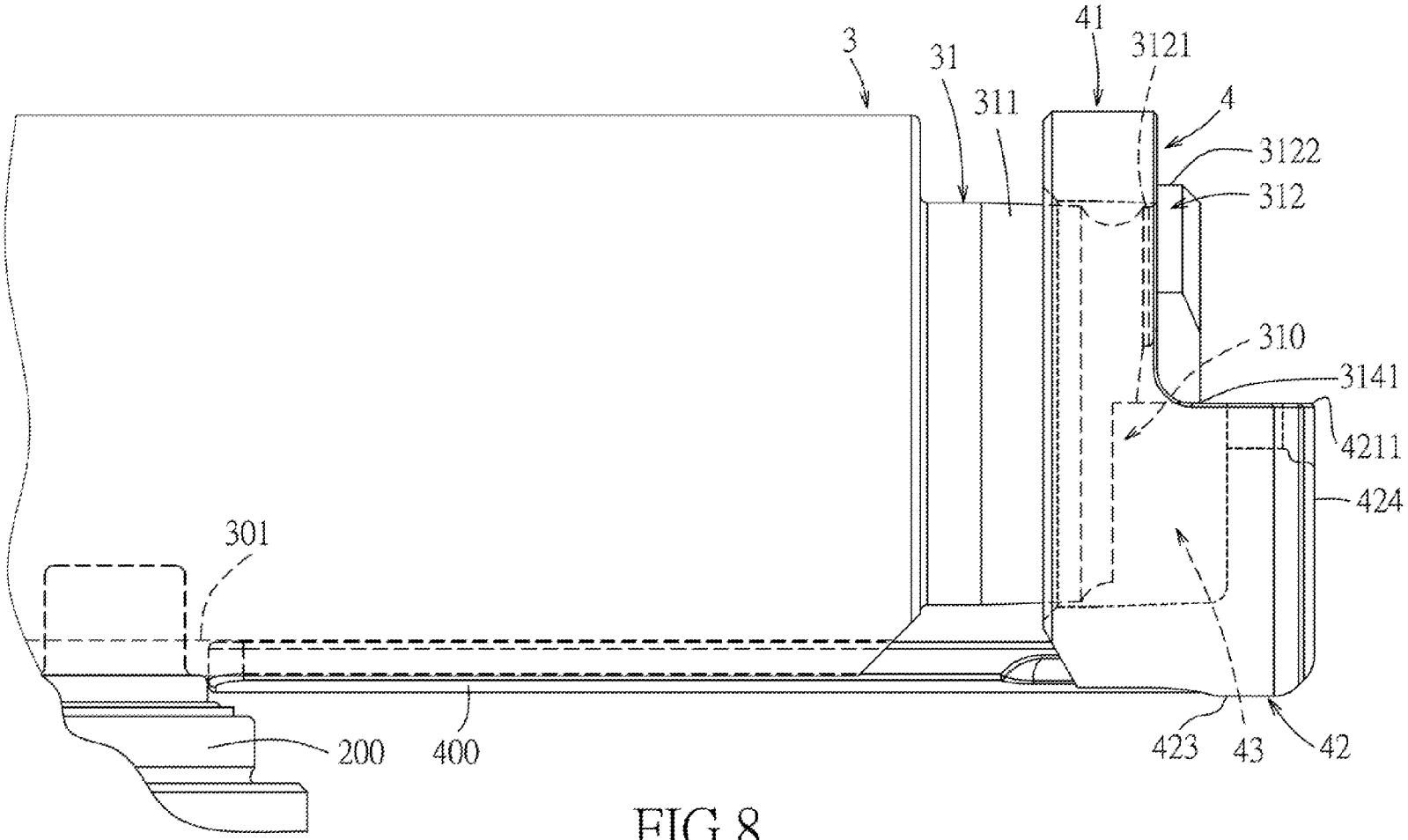
FIG. 8 is a fragmentary schematic view illustrating a second state in which the ejector of the embodiment is disposed at a second axial position relative to the barrel.
Figure 9:
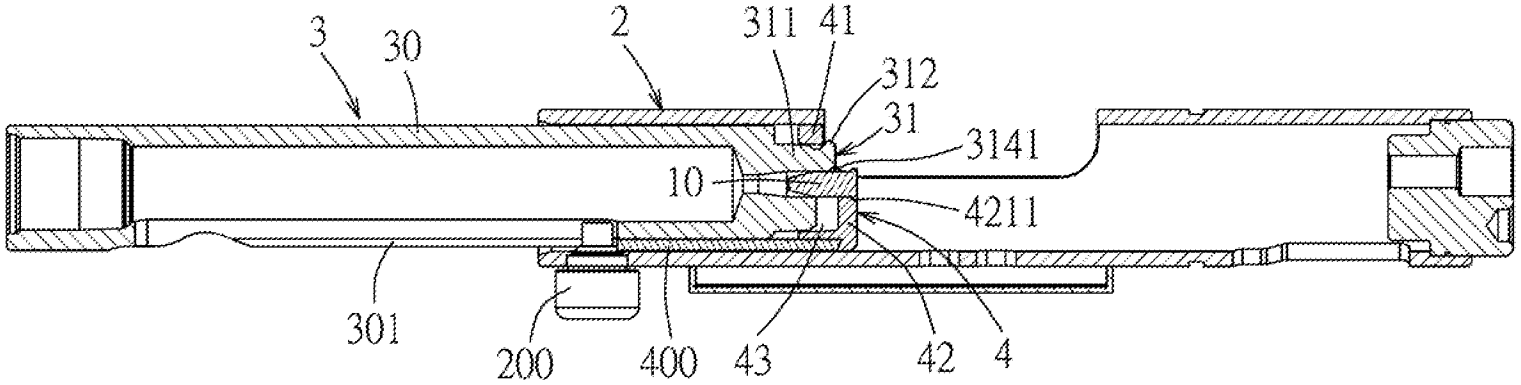
FIG. 9 is a sectional view illustrating the second state of the embodiment.
Figure 10:
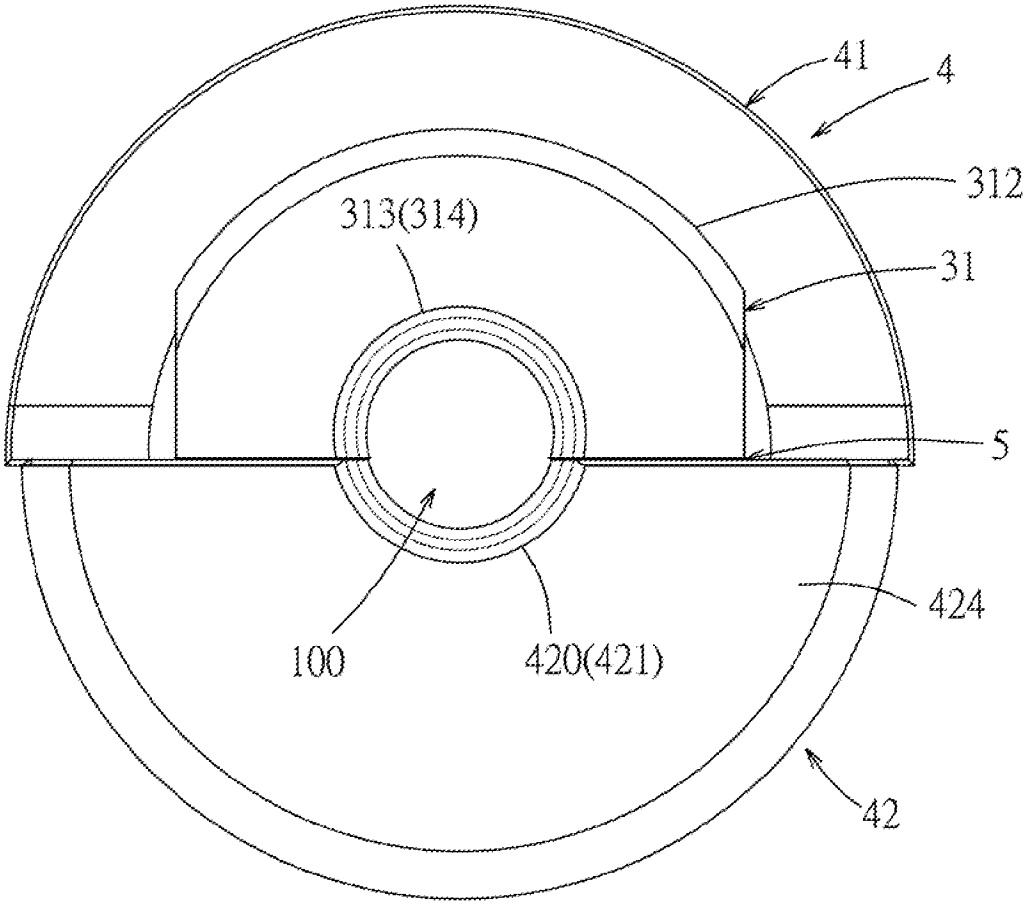
FIG. 10 is a side view of the embodiment.

The ejector 4 is in the form of a generally cylindrical block that has a second cutout recess 40, a sleeve part 41, and a projecting part 42 which protrudes from the sleeve part 41 in the axial direction and which cooperates with the sleeve part 41 to define the second cutout recess 40. The sleeve part 41 is coaxially and slidably sleeved on and in sliding contact with the cylindrical segment 311 so as to permit the ejector 4 to be slidable on the cylindrical segment 311 between a first axial position (see FIGS. 5 to 7) and a second axial position (see FIGS. 8 and 9) for ejecting the explosive cartridge 10 out of the firing end portion 31 of the barrel 3. The projecting part 42 is formed with a second groove 420 that is in spatial communication with the second cutout recess 40, that extends in the axial direction, and that is defined by a second groove-defining surface 421. The second groove-defining surface 421 has an outer edge 4211. When the ejector 4 is disposed at the first axial position, the protruding segment 312 is disposed in the second cutout recess 40, the projecting part 42 extends into the first cutout recess 310, the outer edges 3141, 4211 of the first and second groove-defining surfaces 314, 421 are flush with each other, and the first and second grooves 313, 420 mate each other (i.e., substantially overlap each other over entire lengths of the first and second grooves 313, 420) to define a stepped cylindrical bore 100 (see FIGS. 7 and 10) that is adapted to accommodate the explosive cartridge 10 (see FIG. 5). When the ejector 4 is disposed at the second axial position, the projecting part 42 protrudes outwardly of the first cutout recess 310, the outer edges 3141, 4211 of the first and second groove-defining surface 314, 421 are not flush with each other, and the first and second grooves 313, 420 do not mate each other (i.e., do not overlap each other over the entire lengths of the first and second grooves 313, 420) to define the stepped cylindrical bore 100.

In this embodiment, the protruding segment 312 of the firing end portion 31 of the barrel 3 is generally semi-annular in shape (with a truncated edge) and the projecting part 42 of the ejector 4 has an axially extending section 423 that is generally semi-annular in shape and that extends from the sleeve part 41 in the axial direction, and a radially extending section 424 that is generally semi-annular in shape and that extends from the axially extending section 423 in a radial direction relative to the axial direction. The radially extending section 424 is formed with the second groove 420.

Figure 11:
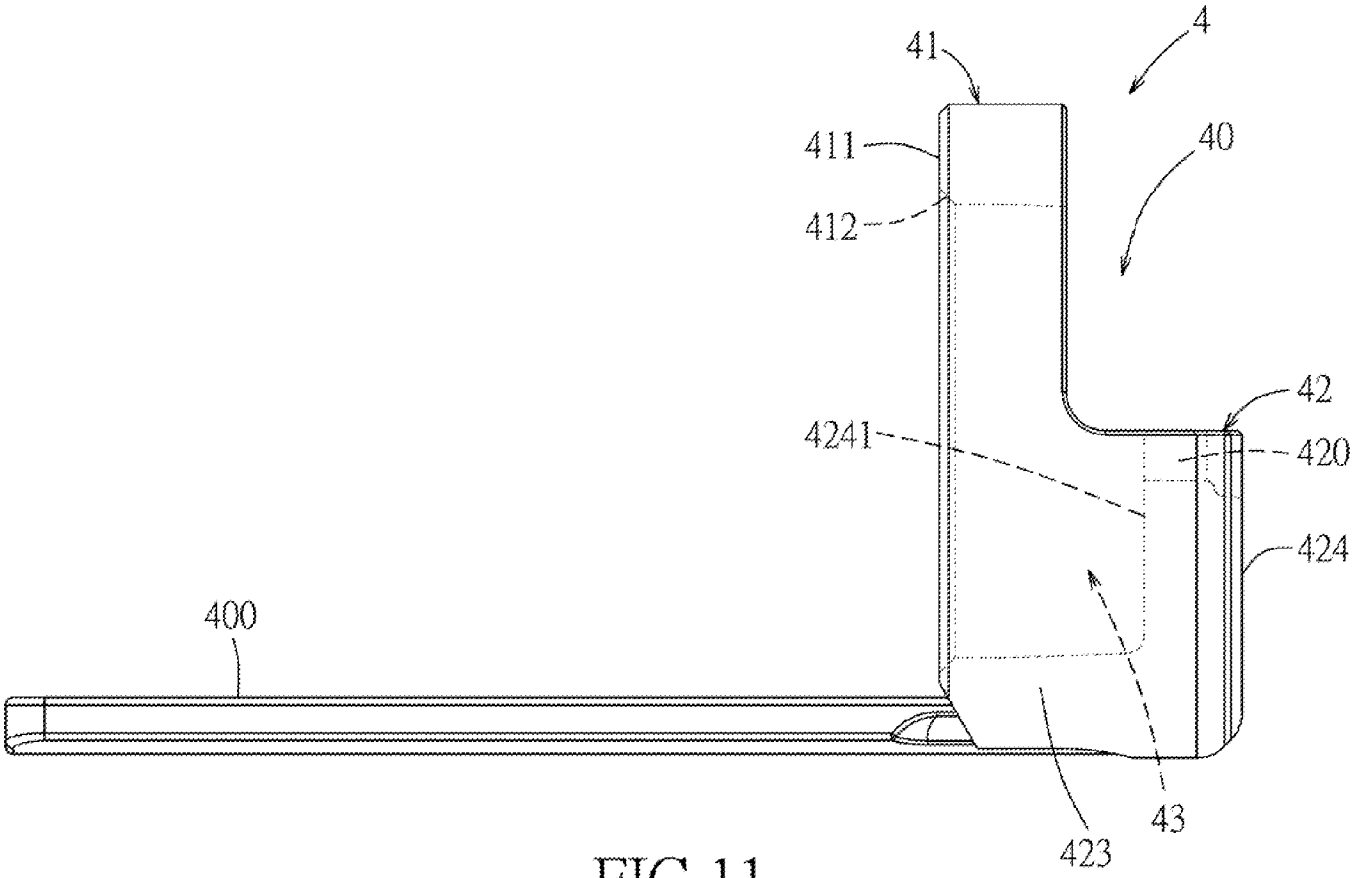
FIG. 11 is a side view of the ejector of the embodiment.
Figure 12:
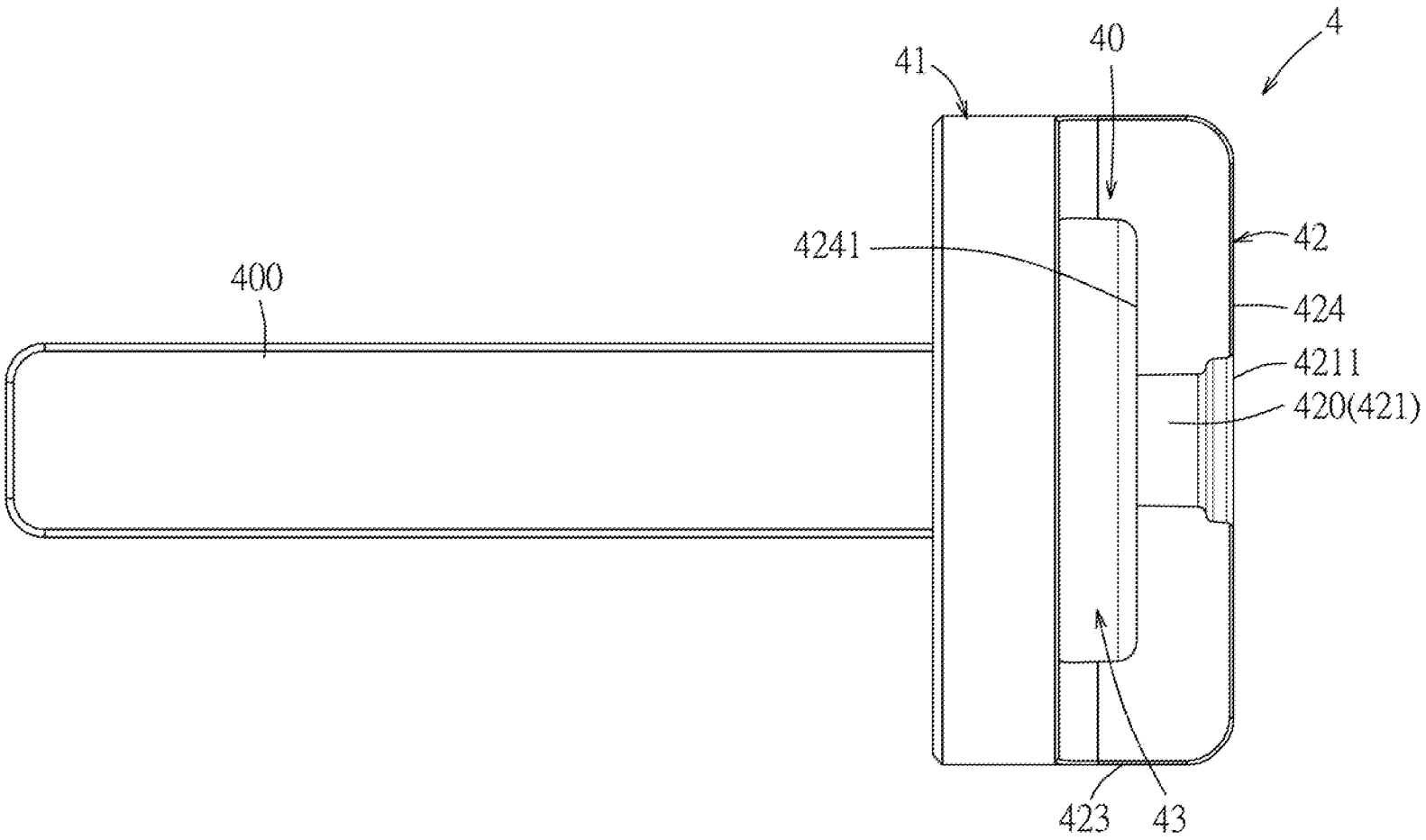
FIG. 12 is a top view of the ejector of the embodiment.
Figure 15:
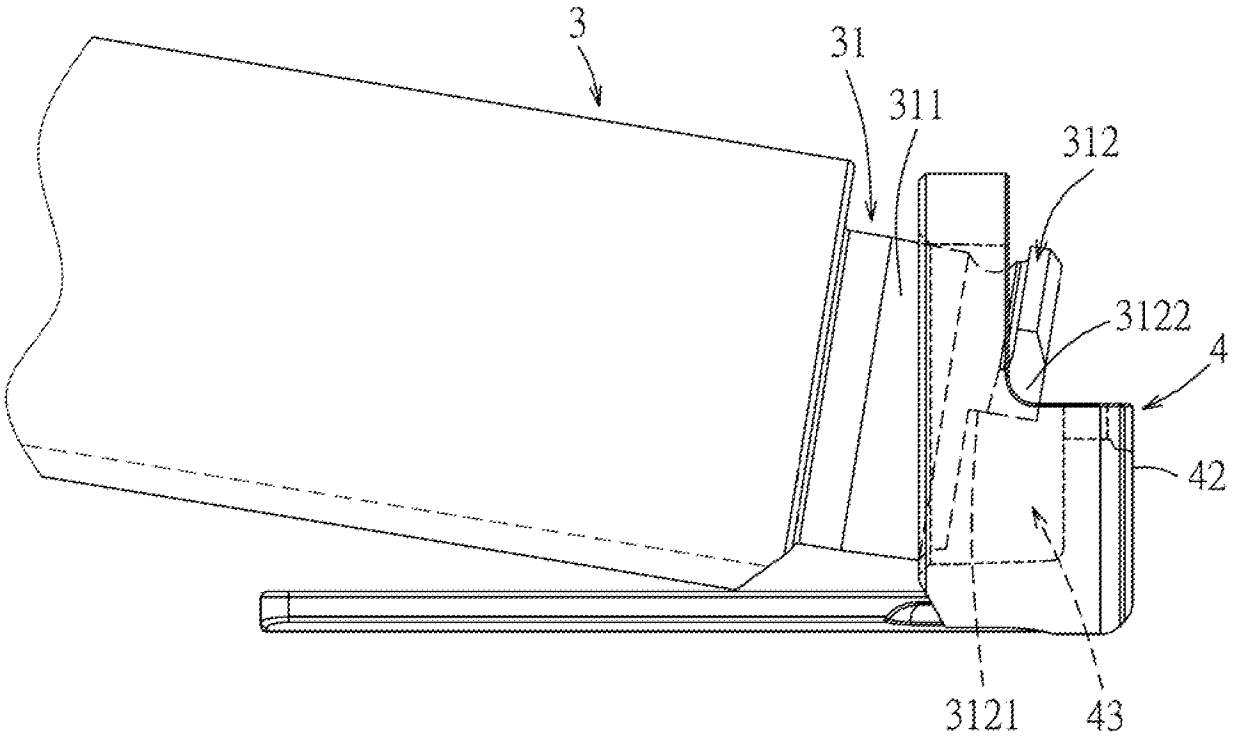
FIG. 15 is a fragmentary schematic side view of the embodiment illustrating how the ejector is removed from the barrel.

The axially extending section 423 cooperates with an inner surface 4241 (see FIGS. 11 and 12) of the radially extending section 424 to define an inner recess 43 therebetween. The inner recess 43 is disposed below and in spatial communication with the second cutout recess 40. The cylindrical segment 311 extends into the inner recess 43 when the ejector 4 is disposed at the first axial position, and is disposed outwardly of the inner recess 43 when the ejector 4 is disposed at the second axial position. The inner recess 43 provides a room for accommodating a portion of the protruding segment 312 during inclination of the firing end portion 31 relative to the ejector 4 (see FIG. 15) when the ejector 4 is disposed at the second axial position for facilitating removal of the ejector 4 from the firing end portion 31.

Figure 13:
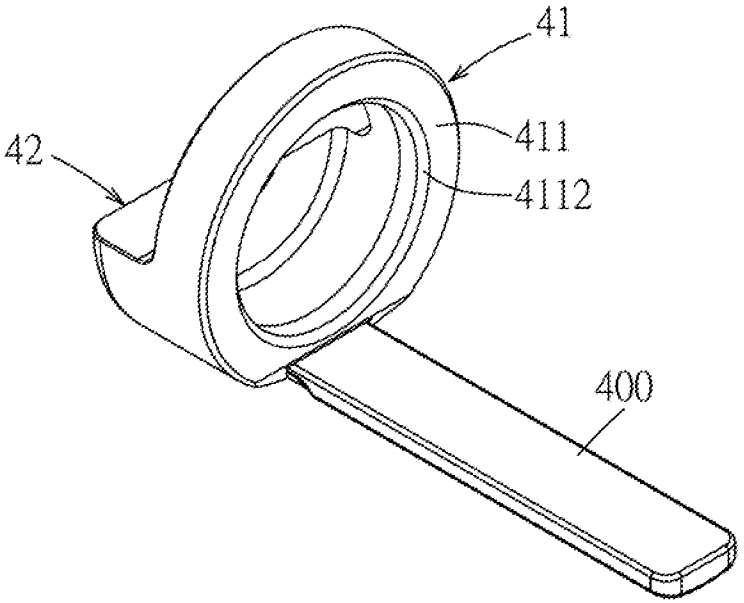
FIG. 13 is a perspective view of the ejector of the embodiment.
Figure 14:
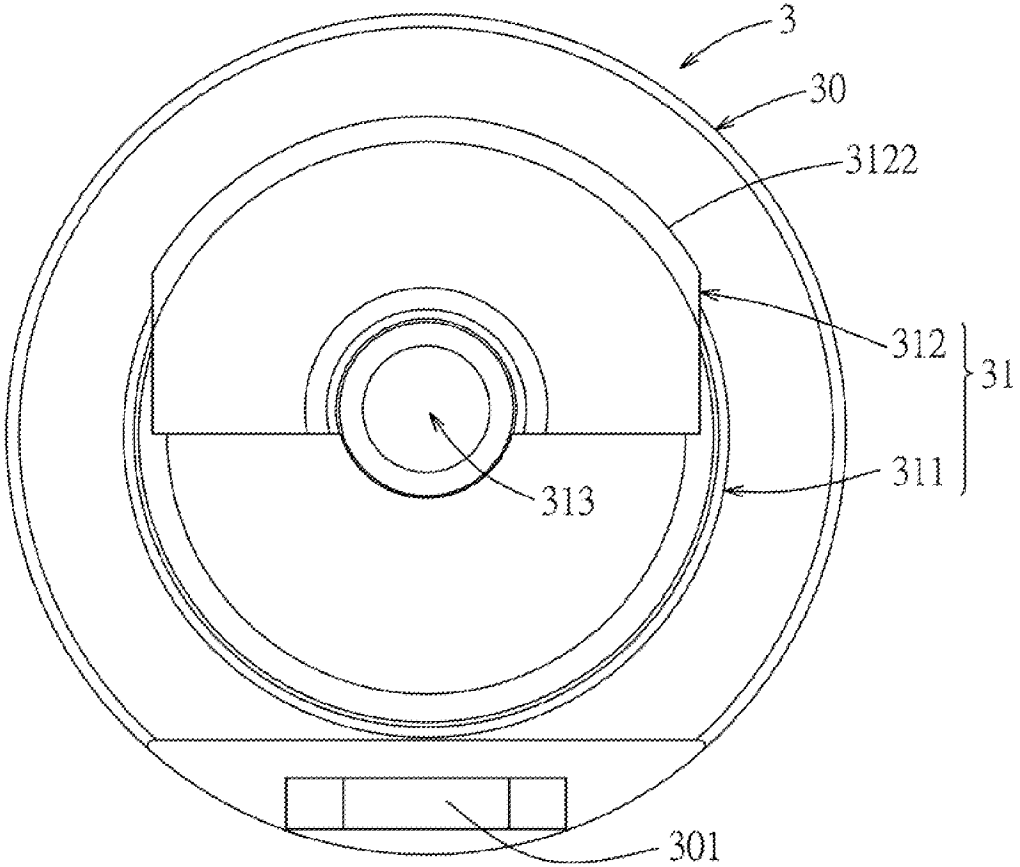
FIG. 14 is a side view of the barrel of the embodiment.

The sleeve part 41 has an inner end face 411 (see FIG. 13) that is opposite to the projecting part 42 in the axial direction and that has a chamfered inner edge 4112 that is in sliding contact with the cylindrical segment 311 and that serves for facilitating removal of the ejector 4 from the firing end portion 31.

The barrel 3 further has a cylindrical main portion 30 that is formed with a guiding groove 301 (see FIGS. 5 and 9) which extends in the axial direction. The firing end portion 31 extends and is reduced in diameter from the main portion 30. The ejector 4 is provided with a driven lever 400 that is connected to the sleeve part 41 and that extends therefrom in the axial direction into the guiding groove 301. A pawl stud 200 is secured to the housing 2, and protrudes therefrom into the guiding groove 301, so that the pawl stud 200 can push the driven lever 400 to drive movement of the ejector 4 from the first axial position to the second axial position.

The protruding segment 312 has a first sub-segment 3121 (see FIGS. 6, 8, 14 and 15) that extends axially from the cylindrical segment 311 and that is generally semi-annular in shape, and a second sub-segment 3122 that extends axially from the first sub-segment 3121 and that is generally truncated semi-annular in shape. Alternatively, the second sub-segment 3122 may be generally semi-annular in shape. The first sub-segment 3121 has an outer radius or a maximum outer width ($R_1$) between an outer periphery thereof and the central axis (X) less than an outer radius or a maximum outer width ($R_2$) of the second sub-segment 3122 between an outer periphery thereof and the central axis (X). The maximum outer width ($R_2$) of the second sub-segment 3122 is greater than an outer radius of the cylindrical segment 311 and an inner radius (Ri) of the sleeve part 41, so that the sleeve part 41 may abut against the second sub-segment 3122 when the ejector 4 is disposed at the second axial position. The sleeve part 41 is adjacent to the main portion 30 when the ejector 4 is disposed at the first axial position. As such, movement of the ejector 4 is limited to a range between the first and second axial positions.

A clearance 5 is formed between the protruding segment 312 and the radially extending section 424 (see FIGS. 6 and 7) when the ejector 4 is disposed at the first axial position. Since the ejector 4 is generally cylindrical in shape (with a cutout) and is coaxially arranged with the cylindrical segment 311 of the firing end portion 31, control of tolerances of the sleeve part 41 and the projecting part 42 and tolerances of the cylindrical segment 311 and the protruding segment 312 becomes relatively easy and higher precision for forming the firing end portion 31 and the ejector 4 can be achieved, which permits narrowing of the clearance 5, thereby alleviating the aforesaid drawbacks associated with the prior art and improving safety of the nail-driving gun barrel assembly.

In addition, since the ejector 4 is in the form of the generally cylindrical block, the mechanical strength of the ejector 4 is enhanced as compared to that of the aforesaid conventional L-shaped ejector 15. As such, the ejector 4 of the present invention can withstand explosive impact without being deformed, and the service life of the ejector 4 can be increased. Moreover, the ejector 4 can be easily assembled on the barrel 3 and disassembled from the barrel 3 for maintenance.

While the present invention has been described in connection with that is considered the most practical embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A nail-driving gun barrel assembly with a safe and robust cartridge ejection mechanism, comprising:

an axially extending barrel extending along an axial direction and having a firing end portion that is adapted to accommodate an explosive cartridge, said firing end portion having a first cutout recess, a cylindrical segment, and a protruding segment that protrudes from said cylindrical segment along said axial direction and that cooperates with said cylindrical segment to define said first cutout recess, said protruding segment being formed with a first groove that extends in said axial direction; and an ejector in the form of a generally cylindrical block that has a second cutout recess, a ring-shaped sleeve part, and a projecting part which protrudes from said sleeve part in said axial direction and which cooperates with said sleeve part to define said second cutout recess, said sleeve part surrounding said cylindrical segment, and being coaxially and slidably sleeved on and in sliding contact with said cylindrical segment so as to permit said ejector to be slidable on said cylindrical segment between a first axial position and second axial position for ejecting the explosive cartridge out of said firing end portion of said barrel, said projecting part being formed with a second groove that extends in said axial direction;

wherein when said ejector is disposed at the first axial position, said protruding segment is disposed in said second cutout recess, said projecting part extends into said first cutout recess, and said first and second grooves mate each other to define a cylindrical bore that is configured to accommodate the explosive cartridge;

wherein when said ejector is disposed at the second axial position, said projecting part protrudes outwardly of said first cutout recess and said first groove and said second groove do not mate each other to define said cylindrical bore; and wherein said barrel has a cylindrical main portion, said firing end portion extending and being reduced in diameter from said main portion, said sleeve part abuts against said protruding segment of said firing end portion when said ejector is disposed at the second axial position, and said sleeve part is adjacent to said main portion when said ejector is disposed at the first axial position.

2. The nail-driving gun barrel assembly of claim 1, wherein said protruding segment of said firing end portion of said barrel is generally semi-annular in shape, said projecting part of said ejector having an axially extending section that is generally semi-annular in shape and that extends from said sleeve part in the axial direction, and a radially extending section that is generally semi-annular in shape and that extends from said axially extending section in a radial direction relative to said axial direction, said radially extending section being formed with said second groove.

3. The nail-driving gun barrel assembly of claim 2, wherein said axially extending section cooperates with said radially extending section to define an inner recess therebetween, said inner recess being in spatial communication with said second cutout recess, said cylindrical segment extending into said inner recess when said ejector is disposed at the first axial position, and being disposed outwardly of said inner recess when said ejector is disposed at the second axial position.

4. The nail-driving gun barrel assembly of claim 3, wherein said sleeve part has an inner end face that is opposite to said projecting part in the axial direction and that has a chamfered inner edge that is in sliding contact with said cylindrical segment.

5. The nail-driving gun barrel assembly of claim 1, wherein said protruding segment has a first sub-segment that extends axially from said cylindrical segment and that is generally semi-annular in shape, and a second sub-segment that extends axially from said first sub-segment and that is generally semi-annular in shape, said first sub-segment having a maximum outer radial width between an outer periphery thereof and a central axis of said barrel which is less than a maximum outer radial width of said second sub-segment between an outer periphery thereof and the central axis, the maximum outer radial width of said second sub-segment being greater than an inner radius of said sleeve part.

6. A nail-driving gun barrel assembly with a safe and robust cartridge ejection mechanism, comprising:

an axially extending barrel extending along an axial direction and having a firing end portion that is configured to accommodate an explosive cartridge, said firing end portion having a first cutout recess, a cylindrical segment, and a protruding segment that protrudes from said cylindrical segment along said axial direction and that cooperates with said cylindrical segment to define said first cutout recess, said protruding segment being formed with a first groove that extends in said axial direction; and an ejector in the form of a generally cylindrical block that has a second cutout recess, a sleeve part, and a projecting part which protrudes from said sleeve part in said axial direction and which cooperates with said sleeve part to define said second cutout recess, said sleeve part being coaxially and slidably sleeved on and in sliding contact with said cylindrical segment so as to permit said ejector to be slidable on said cylindrical segment between a first axial position and a second axial position to eject the explosive cartridge out of said firing end portion of said barrel, said projecting part being formed with a second groove that extends in said axial direction;

wherein when said ejector is disposed at the first axial position, said protruding segment is disposed in said second cutout recess, said projecting part extends into said first cutout recess, and said first groove and said second groove mate each other to define a cylindrical bore that is adapted to accommodate the explosive cartridge;

wherein when said ejector is disposed at the second axial position, said projecting part protrudes outwardly of said first cutout recess and said first groove and said second groove do not mate each other to define said cylindrical bore;

wherein said projecting part of said ejector having an axially extending section that extends from said sleeve part in the axial direction, and a radially extending section that extends from said axially extending section in a radial direction relative to said axial direction, said radially extending section being formed with said second groove;

wherein said axially extending section cooperates with said radially extending section to define an inner recess therebetween, said inner recess being in spatial communication with said second cutout recess, said cylindrical segment extending into said inner recess when said ejector is disposed at the first axial position, and being disposed outwardly of said inner recess when said ejector is disposed at the second axial position; and wherein said sleeve part has an inner end face that is opposite to said projecting part in the axial direction and that has a chamfered inner edge that is in sliding contact with said cylindrical segment.

* * * * *